United States Patent [19]

Frantz et al.

[11] Patent Number: 4,842,529

[45] Date of Patent: Jun. 27, 1989

[54] CONNECTOR WITH TWO-PIECE GROUND STRAP

[75] Inventors: Robert H. Frantz, Newville; Robert N. Whiteman, Jr., Middletown, both of Pa.

[73] Assignee: AMP Incorporated, Harrisburg, Pa.

[21] Appl. No.: 175,838

[22] Filed: Mar. 31, 1988

[51] Int. Cl.[4] ..... H01R 13/648

[52] U.S. Cl. ..... 439/95; 439/97; 29/592.1

[58] Field of Search ..... 439/63, 92, 95, 97, 439/607, 609, 610; 29/592.1

[56] References Cited

U.S. PATENT DOCUMENTS

| | | | |
|---|---|---|---|
| 4,506,937 | 3/1985 | Cosmos | 339/19 R |
| 4,512,618 | 4/1985 | Kumar | 339/19 R |
| 4,653,838 | 3/1987 | Ney | 339/147 R |
| 4,659,163 | 4/1987 | Althouse et al. | 439/608 |
| 4,690,479 | 9/1987 | Hollyday | 439/97 |
| 4,721,473 | 1/1988 | Delguidice | 439/79 |

OTHER PUBLICATIONS

Drawing Sheet Showing FIGS. 1–3 of Great Britain Patent Application No. 8716428 Filed Jul. 13, 1988.

*Primary Examiner*—Eugene F. Desmond
*Attorney, Agent, or Firm*—David L. Smith

[57] ABSTRACT

An electrical connector (20) has a dielectric housing (22) defining a mating face (26) and a mounting face (58). The housing (22) has a plurality of terminal receiving passages (30) extending from the mating face with terminals (32) secured therein. An eletrically conductive shell (36) has a shroud portion (44) that encircles the mating face (26) to engage shielding of a complementary shielded connector and to shield the terminals (32) secured in the housing (22). A tab (48) extends from the shell (36) to interengage with a ground strap (52) and secure the ground strap (52) to the connector (20). A ground path is thereby completed from the shell (36) through the tab (48) then the ground strap (52), and possibly a securing means (92), to a ground pad (118*a*;118*b*) on a printed circuit board (120) on which the connector (20) is mounted.

14 Claims, 6 Drawing Sheets

CONNECTOR WITH TWO-PIECE GROUND STRAP

BACKGROUND OF THE INVENTION

Shielded connectors have been electrically connected to a ground by various means, such as using a formed metal shell by which the shield is grounded when a connector is physically attached to a printed circuit board. For example, pin or socket subminiature D connectors having a metal shell and contacts either straight or right angle, are often mounted in an electrical system having a common ground. Typically, the metal shell surrounding the front face of a subminiature D connector is made of a soft steel which is either zinc or tin-plated and is formed by dies which draw the soft steel into the desired shape, such as a D-configuration having a flat base and a raised D-section known as a shroud.

Other die-formed parts and shapes obtained during the drawing and die-punching operation of the metal shell include integral ground straps and apertures by which grounding of the shell is accomplished. These additional parts and shapes complicate the die manufacture and increase the cost of parts manufacture.

After the drawing and die-punching operation, the subminiature D connector shells are subjected to additional manufacturing steps, including plating. Plating is often achieved by a barrel-plating process during which some of the shells are damaged. Additional damage occurs during shipment of the shells prior to assembly of shells to housings. A portion of the damaged shells can be salvaged and manually restored in their desired shapes; the remainder of the damaged shells are too severely damaged and must be discarded as scrap. The additional labor cost to salvage a portion of the damaged shells, when combined with the economic loss due to discarding as scrap shells too severely damaged to be salvaged, significantly increases the unit cost of useful shells.

A majority of the damage occurs to the ground strap which is an integral part of the shell. The ground strap typically extends normal to the flat base in the opposite direction of the shroud. The length of the ground strap varies depending upon the connector. Longer ground straps typically result in a greater percentage of damaged shells and a greater percentage of damaged shells that must be discarded as scrap.

What is needed is a shell and ground strap that is not damaged during the plating process or shipping, that eliminates the need for manual reshaping and results in little or no loss due to scrap.

SUMMARY OF THE INVENTION

In accordance with the present invention, an electrical connector has a dielectric housing defining a mating face and a mounting face. The housing has a plurality of terminal receiving passages extending from the mating face with terminals secured therein. An electrically conductive shell has a shroud portion that encircles the mating face to engage shielding of a complementary shielded connector and to shield the terminals secured in the housing. A tab extends from the shell to interengage with a ground strap and secure the ground strap to the connector. A ground path is thereby completed from the shell through the tab thence the ground strap, and possibly a securing means, to a ground pad on the printed circuit board on which the connector is mounted.

DESCRIPTION OF THE PREFERRED EMBODIMENT

Figure 1:
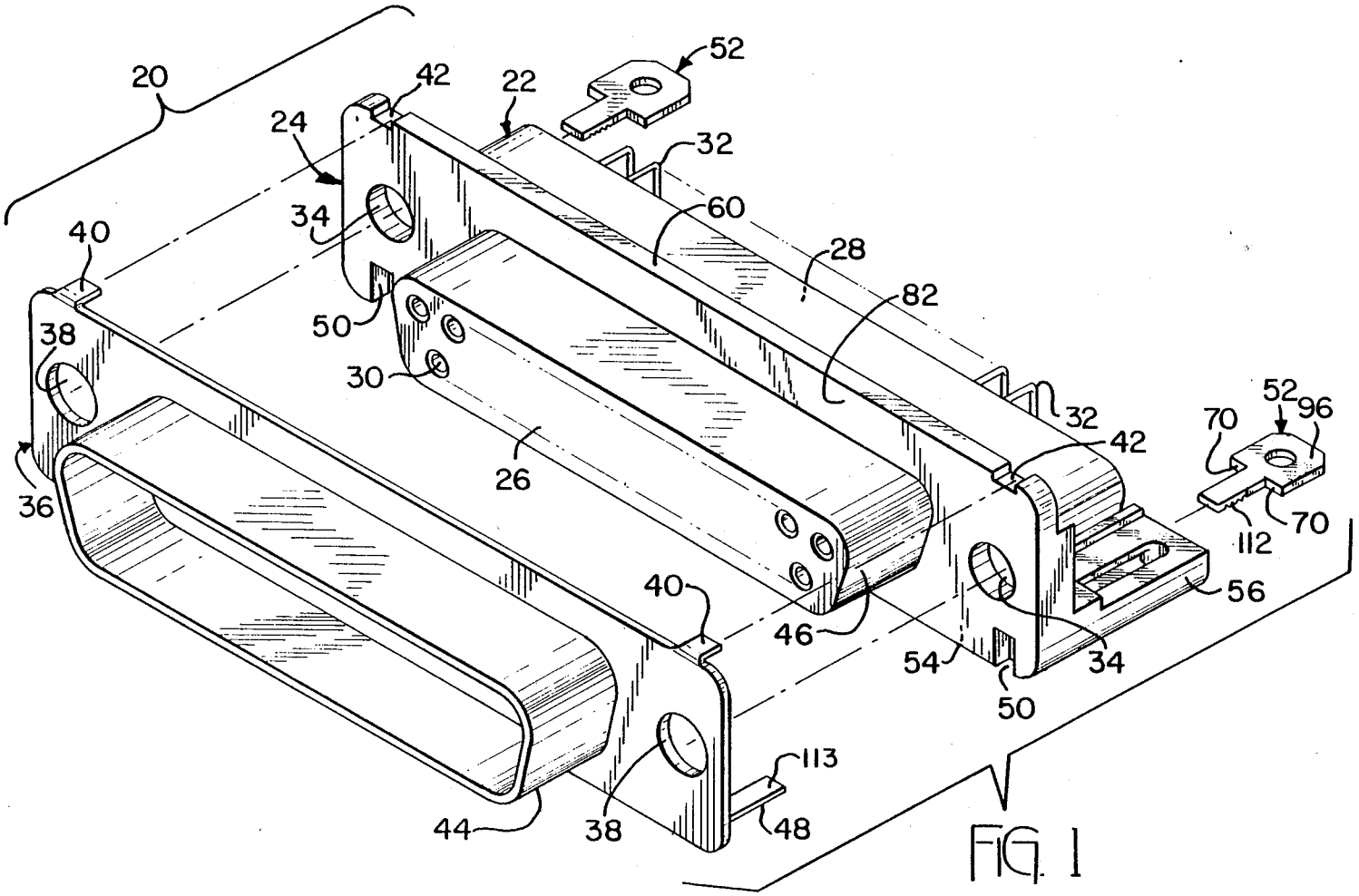
FIG. 1 is an exploded perspective view of a subminiature D connector having a two-piece ground strap in accordance with the present invention.

Referring to the drawing, initially in FIG. 1, there is depicted therein an exploded perspective view of a connector 20 having a two-piece ground strap in accordance with the present invention. The connector 20 shown is exemplary and is one of a well known type, namely a subminiature D connector manufactured by the assignee, AMP Incorporated, and sold under the trademark AMPLIMITE.

Connector 20 has insulative housing 22 molded of thermal plastic with integral peripheral flange 24, a mating face 26, and opposed rear face 28 with a plurality of contact receiving passages 30 extending therebetween having contacts 32 secured therein. Flange 24 has mounting apertures 34 at opposite ends thereof for securing a complementary connector thereto.

Electrically conductive shell 36 has a similar outer profile to flange 24 with the mounting apertures 38 aligned with apertures 34. Lugs 40 on the upper portion of shell 36 fold into recesses 42 on flange 24 to secure shell 36 to housing 22. Shroud 44 extends upward from the flat portion of shell 36 and conforms to and encloses the forward raised portion 46 of housing 22. Shroud 44 shields the mating face and contacts 32. Lugs 48 on the lower portion of shell 36 fold into recesses 50 on flange 24 thereby securing shell 36 to housing 22. Lugs 48 also secure ground straps 52 to housing 22 as will be discussed in more detail below.

Bottom face 54 of exemplary connector 20 is at a right angle with respect to mating face 26. Bottom face 54 has integral flanges 56 at opposite ends thereof. Each flange 56 has a coplanar mounting face 58 (see FIG. 3) which is received against a printed circuit board, not shown.

FIG. 1 shows as part of housing 22 a raised portion 46 having contact receiving passages 30 with contacts 32 secured therein that are sockets. A housing 22 which serves as a plug connector will have contacts 32 that are pins, may have an electrically conductive shell 36, but will not have a raised housing portion 46.

Figure 2:
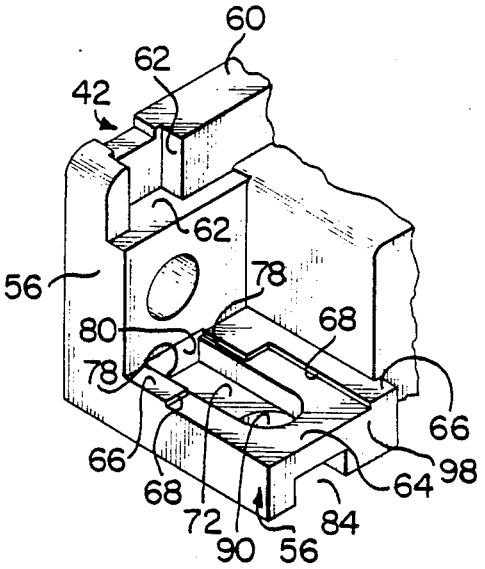
FIG. 2 is a rear perspective view of the mounting flange of the connector shown in FIG. 1.

FIG. 2 shows the rear view detail of recess 42 in flange 24 which receives lugs 40. Lugs 40 fold through recesses 42 to be substantially flush with the top surface 60 of flange 24 thence extend downward into recess 62 thereby securing shell 36 to housing 22.

Aperture 34 illustrates the means for securing connector 20 to a complementary connector, not shown, such as by a fastener, also not shown. Aperture 34 may carry an embedded screw lock, not shown, or may serve merely as an aperture for any threaded fastener with a nut or like means for joining connector 20 to a complementary connector.

Contacts 32 are insulated from each other, housed in housing 22 and may have any known configuration or arrangement. Housing 22 may be a straight contact connector, not shown, or a right angle contact connector.

Ground strap recess 64 recessed below the plane of holding face 66 substantially the thickness of ground strap 52 accepts ground strap 52 and restrains ground strap shoulder 70 (FIGS. 1 and 4) against barrier ledges 68. Ground strap recess 64 is in the form of a ground strap 52 in FIGS. 4*a*–4*e* and is replicated in the housing 22. Thus, recess 64 may take various forms so as to accommodate the particular ground strap 52 configuration.

Figure 7:
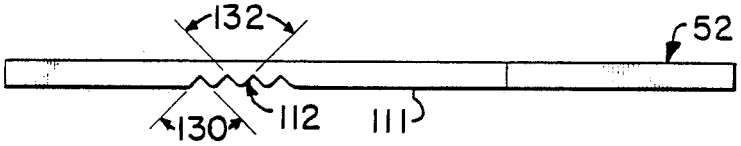
FIG. 7 is a side view of a ground strap prior to forming, illustrating serrations.

As shown in FIG. 2, a further recessed channel 72 accommodates the insertion of ground strap 52 therein, either in the formed condition shown in FIGS. 4*a*–4*e*, or as straight member as illustrated in FIGS. 1 and 7. It is preferable to insert ground strap 52 as a straight member and form ground strap 52 in a separate operation while ground strap 52 is positioned in recesses 64.

Figure 3:
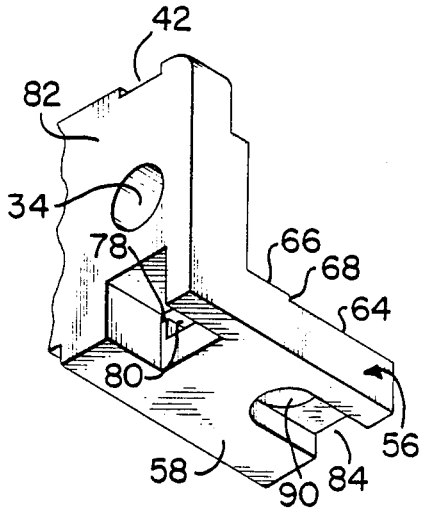
FIG. 3 is a bottom perspective view of the mounting flange shown in FIG. 2.

When inserted as a straight member for subsequent forming, the contact portion 74 and the tab 76 (see FIG. 4) of ground strap 52 are guided laterally by ledge 78 shown in FIGS. 2 and 3. Ledge 78 may extend forwardly as a small channel in the walls of recess 50, not shown, for more positive formation of contact portion 74.

Figure 2A:
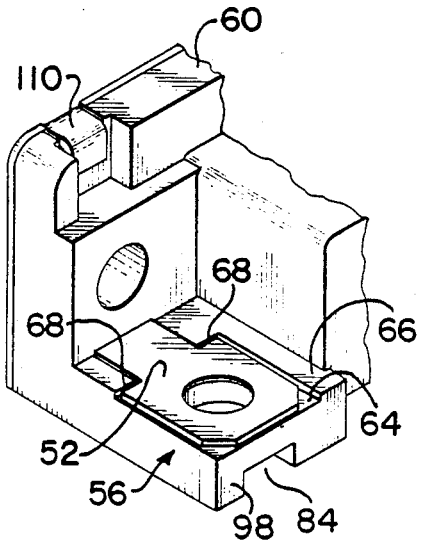
FIG. 2*a* is a rear perspective view of the mounting flange as shown in FIG. 2 having a two-piece ground strap assembled thereto.
Figure 3A:
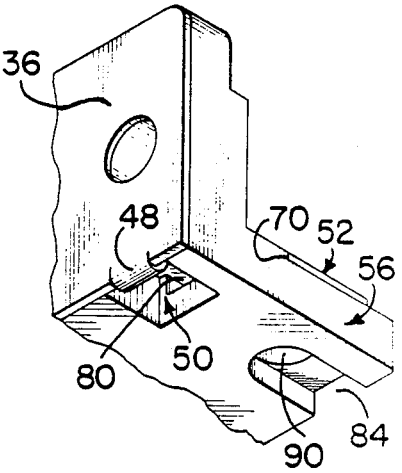
FIG. 3*a* is a bottom perspective of the mounting flange as shown in FIG. 3 having a two-piece ground strap assembled thereto.
Figure 11:
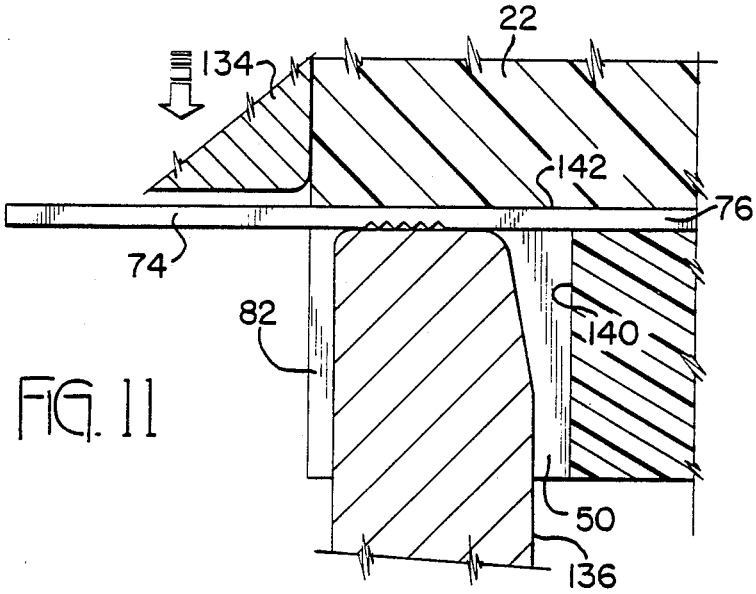
FIG. 11 illustrates the additional step required to form a ground strap in place in the housing.

The area between ledges 78 forms aperture 80 opening into recess 50 in flange 24 of housing 22 to receive a ground strap 52 as a flat member. With a flat ground strap 52 inserted into recess 64 until shoulder 70 seats against barrier ledges 68 as shown in FIG. 2*a*, contact portion 74 of ground strap 52 extends forward of front surface 82 of flange 24 as best shown in FIG. 11. Contact portion 74 may then be formed in place. In a preferred embodiment, contact portion 74 is formed in place by being bent normal to the plane of ground strap 52, extending toward mounting face 58 with the surface of contact portion 74 flush with front surface 82 of flange 24. Forming contact portion 74 after insertion of ground strap 52 is discussed in more detail below.

A pre-formed ground strap 52 such as shown in FIGS. 4*a*–4*e* may also be inserted into housing 22 to engage flange 56. Recessed channel 72 accommodates contact portion 74 during insertion of a pre-formed ground strap 52. A pre-formed ground strap inserted into recess 64 until shoulders 70 seat against barrier ledges 68 would also have contact portion 74 extending normal to the plane of ground strap 52, toward mounting face 58, with the surface of contact portion 74 flush with front surface 82 of flange 24.

Figure 4A:
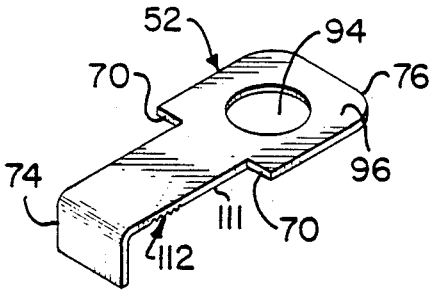
FIGS. 4*a*–4*e* are perspective views of various embodiments of the ground strap used in FIGS: 1 to 3*a;*
Figure 4B:
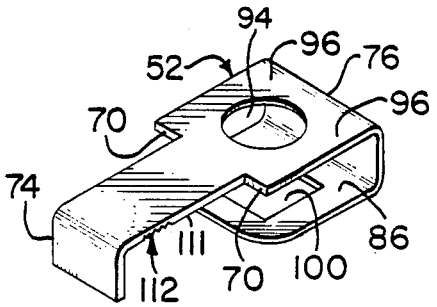

Channel 84 in mounting face 58 accommodates tab 86 in the embodiment of ground strap 52 shown in FIG. 4*b*.

Figure 6:
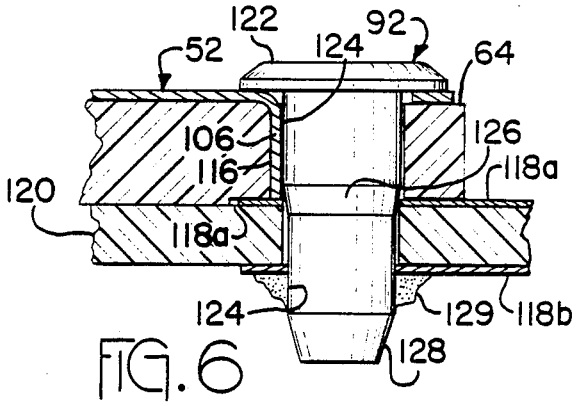
FIG. 6 is a partial cross-sectional view of a final assembly of the connector shown in FIG. 1 secured to a printed circuit board, incorporating an embodiment of the two-piece ground strap shown in FIGS. 4*d* and 5.

Aperture 90 extends through flange 56 between mounting face 58 and holding face 66 and accommodates securing means 92 for securing housing 22 of connector 20 to a printed circuit board 120. Aperture 94 in ground straps 52 align with aperture 90 in flanges 56 to accommodate securing means 92 (see FIG. 6) when shoulders 70 of ground strap 52 seat against barrier ledges 68. Securing means 92 is shown in FIG. 6 as a rivet but may be any other means, such as a bolt and nut. Securing means 92 may be integral with ground strap 52 as shown in FIG. 4*e* in which a drawn rivet 110 is formed as an integral part of ground strap 52 substantially at the location where aperture 94 would otherwise be.

FIGS. 4*a*–4*e* show various embodiments of ground strap 52. The embodiment of ground strap 52 shown in FIG. 4*a* depicts contact portion 74 formed normal to the plane of upper surface 96. Aperture 94 extends through ground strap 52 to accommodate mounting means.

In the embodiment of ground strap 52 shown in FIG. 4*b*, ground strap 52 folds down over rear surface 98 and extends under flange 56. Aperture 100 aligns with aperture 94 for passage therethrough of securing means. Ground strap 52 wrapping down over rear surface 98 may aid or replace shoulders 70 in maintaining ground strap 52 in position, may be recessed in flange 56, and may make a ground by direct contact with a ground pad on a circuit board.

Figure 4C:
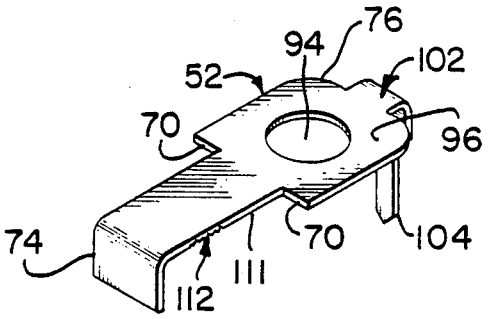

In the embodiment of ground strap 52 shown in FIG. 4*c*, tab 102 extends rearwardly and is adapted to fold down over rear surface 98 of flange 56. Tab 102 folding down over rear surface 98 may aid or replace shoulders 70 in maintaining ground strap 52 in position. Tab 102 terminates in solder tail 104 which extends beyond mounting face 58 and may be soldered in a plated through hole to secure the connector assembly to a printed circuit board as well as provide a common ground therewith.

Figure 4D:
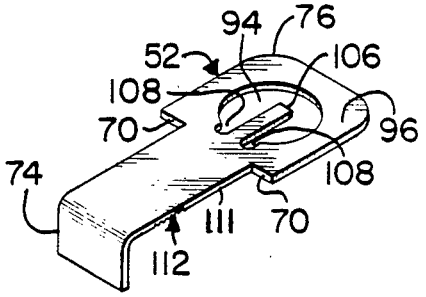
Figure 4E:
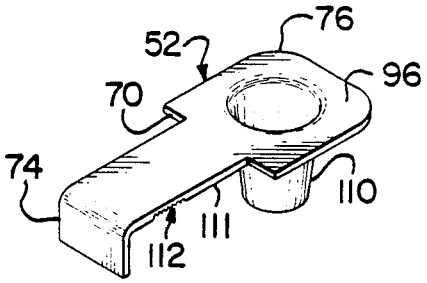

In the FIG. 4*d* embodiment of ground strap 52, aperture tab 106 extends into aperture 94 providing wiping engagement with securing means inserted therein. Relief indentations 108 permit aperture tab 106 to be bent down and maintain biased engagement with securing means. Inwardly directed aperture tab 106 may contact only the securing means inserted into aperture 94 or it may contact a ground on the printed circuit board 120 as shown in FIG. 6. This embodiment may be used as a preassembly and will be discussed further below.

The ground strap 52 in the FIG. 4*e* embodiment illustrates an integral drawn rivet 110 instead of an aperture. Integral drawn rivet 110 extends beyond mounting face 58 and serves the same function that securing means 92 otherwise would.

Ground straps 52 in all embodiments 4*a*–4*e* are shown with serrations 112 on the underside 111 of the ground strap 52. Serrations 112 are not required, as discussed in greater detail below.

Figure 5:
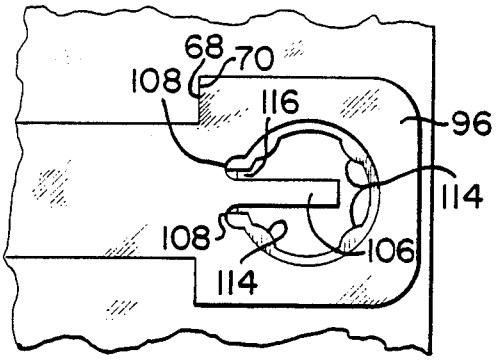
FIG. 5 is a partial top plan view of a ground strap shown in FIG. 4*d* with a connector housing.

FIG. 5 shows a top view of the FIG. 4*d* ground strap positioned over aperture 90 in flange 56. Aperture 90 has interference fit ribs 114 extending inwardly from the periphery thereof providing an effective reduced diameter which provides an interference fit with securing means. Channel 116, into which aperture tab 106 folds, extends parallel with the axis of aperture 90 and opens into aperture 90. Channel 116 receives aperture tab 106 and in the embodiment wherein tab 106 contacts a ground 118*a* 0369 on the printed circuit board 120, channel 116 extends substantially through flange 56 as shown in cross-section in FIG. 6. Relief indentations 108 extend radially outward beyond the periphery of aperture 90 and upon insertion of securing means into aperture 90 aperture tab 106 bends into channel 116. Aperture tab 106 remains in biased engagement with the securing means, thus poviding a ground path therebetween, and by appropriate length and formation tab 106 may engage ground pad 118*a* directly.

The securing means illustrated in FIG. 6 is a rivet 122. The interference fit of the shank 124 of rivet 122 with interference fit ribs 114 around the periphery of aperture 90 secures shank 124 therein. The transition region 126 of rivet 122 provides centering and seating of shank 124 against interference fit ribs 114.

Beveled end 128 provides guided entry for rivet 122 in apertures 90 and 94. Beveled end 128 also acts as a cam urging aperture tab 106, when present, into channel 116 during insertion of rivet 122 into apertures 90 and 94. Securing means 92 are soldered 129 during a soldering process to complete a ground path and secure connector 20 to printed circuit board 120.

Figure 8:
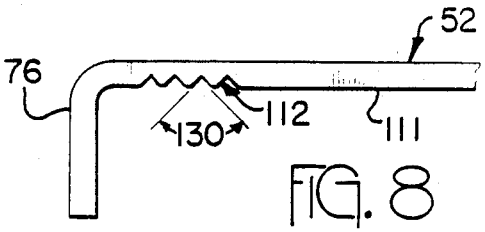
FIG. 8 is a side view of the ground strap of FIG. 7 subsequent to forming but prior to attachment of a metal shell to the connector.

FIG. 7 shows a side view of ground strap 52 prior to forming and FIG. 8 shows a side view subsequent to forming. The lower surface 111 of ground strap 52 has serrations 112 therein. Serrations 112 extend partially through and laterally across lower surface 111 of ground strap 52 in the form of a rack.

Serrations 112 may take various forms. As shown in FIGS. 7 and 8, serrations 112 extend laterally across the under side 111 of ground strap 52 in the form of a rack. In a preferred embodiment, recessed angle 130 is a right angle oriented at 45 degrees from a surface of ground strap 52; exposed angle 132 is also a right angle with a small radius to provide a rounded edge. Tab 76 of ground strap 52 has been formed to be substantially perpendicular to contact portion 74 in FIG. 8.

As stated above, serrations 112 are not required. A corner edge 113 of tab 48 can bite into the surface of ground strap 52 to grip ground strap 52 providing electrical and mechanical engagement therebetween. Serrations 112 provide specific locations for corner 113 to seat and enhance engagement.

Figure 9:
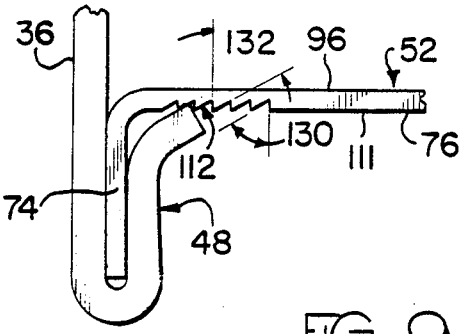
FIG. 9 is a side view of a ground strap such as depicted in FIGS. 4*a*–4*e*, secured to the ground tab of the metal shell shown in FIG. 1.

FIG. 9 shows an embodiment of serrations in ground strap 52 in which neither recessed angle 130 nor exposed angle 132 are right angles. FIG. 9 also shows a side view of ground strap 52 secured to a lug 48. Tab 76 of ground strap 52 is crimped between shell 36 and lug 48 with lug 48 ratcheted in serrations 112. In this manner, tab 76 is secured both from the front and rear thereof between shell 36 and integral lug 48.

Figure 10:
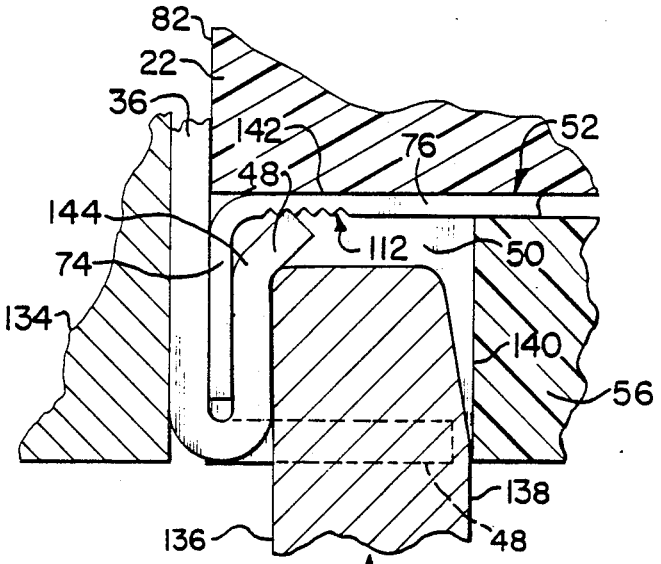
FIG. 10 illustrates a method for assembly of a ground strap with a ground tab on a metal shell.

The process by which lug 48 is ratcheted in serrations 112 and contact portion 74 is crimped between shell 36 and lug 48 is illustrated in FIG. 10. Contact portion 74, after being formed as described above, extends toward mounting face 58 with a surface of contact portion 74 flush with front surface 82 of flange 24. Anvil 134 maintains shell 36 against front surface 82 of housing 22. Lug 48, which initially is substantially normal and extending rearward of shell 36, as shown in FIG. 1 and in phantom in FIG. 10, is bent into recess 50 as tool 136 moves upward in FIG. 10 into recess 50. Tool 136 has a cam section 138 at the rear thereof which engages back wall 140 of recess 50. Upon entry into recess 50, tool 136 bends lug 48 to engage contact portion 74 while anvil 134 maintains the position of shell 36 and contact portion 74. With tab 76 resting against the top wall 142 of recess 50, as tool 136 continues to enter recess 50 to a predetermined depth the end of lug 48 is ratcheted into serrations 112, lug 48 bends at 144 and the end of lug 48 seats in one of the serrations 112. Tool 136 may be withdrawn from recess 50; ground strap 52 will remain interlocked with shell 36 and lug 48.

Lug 48 bends to form a U-shaped structure with contact portion 74 crimped in between the legs of the U. The end of lug 48 is springingly biased between serrations 112 in ground strap 52 and contact portion 74 thereby securing lug 48 to ground strap 52. Ground strap 52 cannot move toward shell 36 due to shoulders 70 and is prevented from being moved away from shell 36 due to being between shell 36 and lug 48. The location of serrations 112 on lower surface 111 of ground strap 52 as well as the length of contact portion 74 and the length of lug 48 are selected to assure the above described biased interlock thereby assuring both electrical and mechanical interconnection. In this manner, tab 48 holds contact portion 74 substantially flush with surface 82 while the edge 113 of tab 48 grips ground strap 52, securing ground strap 52 in housing 22.

To form tab 76 in place requires an additional step, as shown in FIG. 11. With housing 22 secured and ground strap 52 inserted to engage shoulders 70, tool 136 secures contact portion 74 of ground strap 52 against top wall 142 of recess 50. Anvil 134 moves downward, as indicated in FIG. 11, and bends contact portion 74 substantially normal to tab 76 such that contact portion 74 is flush with front surface 82 of housing 22. Tool 136 and anvil 134 are then withdrawn. Shell 36 may be applied to housing 22 and lug 48 formed into biased engagement with ground strap 52 as illustrated in FIG. 10 and as described above.

Figure 12:
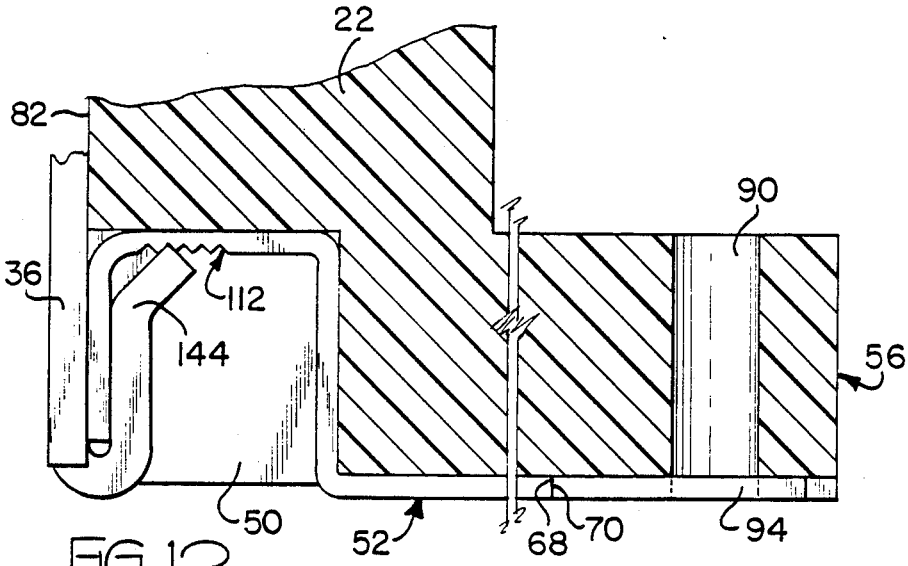
FIG. 12 is an alternate embodiment two-piece ground strap which engages the flange mounting face.

In an alternate embodiment shown in FIG. 12, ground strap 52 extends along mounting face 58 and may be mounted in a ground strap recess 64' with shoulders 70 engaging ledges 68'. Ground strap 52 folds into recess 50 and is otherwise secured, as described above.

We claim:

1. An electrical connector for mounting to a printed circuit board, comprising:

a dielectric housing defining a front surface, said housing having a plurality of terminal receiving passages with terminals secured therein, said housing having an integral flange defining a mounting face for engaging the printed circuit board and an opposed holding face, said housing having a recess in the front surface, said recess having an opening in communication with the holding face;

an electrically conductive shell, said shell having a shroud portion disposed proximate the mating face to engage shielding of a complementary shielded connector and to shield the terminals, said shell having a tab extending into said recess; and a ground strap, received against the flange, said ground strap having a tab portion and a contact portion, said tab portion received in said opening and extending into said recess, the tab of said shell folded over said tab portion and biasingly engaging said ground strap, whereby the ground strap is secured to the connector.

2. An electrical connector as recited in claim 1, further comprising serrations in said ground strap, the tab of said shell engaging said serrations.

3. An electrical connector as recited in claim 1 wherein the ground strap is received against the holding face of the flange.

4. An electrical connector as recited in claim 1 wherein the ground strap further comprises a solder tail integral with said contact portion of said ground strap, said solder tail extending beyond said mounting face for disposition in a hole in the printed circuit board.

5. An electrical connector as recited in claim 1 further comprising a first shoulder means on the housing, directed away from said front surface and a second shoulder means on said ground strap for engaging said first shoulder means and for preventing movement of said ground strap toward said front face.

6. An electrical connector as recited in claim 5 wherein the first shoulder means comprises a shoulder in the holding surface.

7. An electrical connector as recited in claim 1 wherein the contact portion of the ground strap folds over the flange to also engage the opposing face of the flange.

8. An electrical connector as recited in claim 7 wherein the opposing face is the mounting face.

9. An electrical connector as recited in claim 1 wherein the integral flange further comprises a flange aperture extending between the mounting face and the holding face.

10. An electrical connector as recited in claim 9 wherein said ground strap further comprises integral securing means aligned with said flange aperture.

11. An electrical connector as recited in claim 9 wherein said ground strap further comprises an aperture aligned with said flange aperture.

12. An electrical connector as recited in claim 11 wherein the ground strap further comprises an aperture tab extending into said aperture aligned with said flange aperture, said aperture tab adapted to bend upon insertion of securing means and adapted to provide wiping engagement with securing means inserted in said aperture.

13. A method of securing a ground strap to an electrical connector having a housing and an electrically conductive shell with an integral tab, comprising the steps of:

inserting the ground strap in a recess in the housing;

bending an end of the ground strap such that a surface of the end is flush with a face of the housing; and crimping the tab portion of the shell over the bent end of the ground strap to secure the ground strap to said shell.

14. A method of securing a ground strap to an electrical connector as recited in claim 13 wherein a surface of the end of the ground strap has serrations therein and the step of crimping the tab further comprises:

folding the tab over the end of the ground strap to capture the end of the ground strap between the tab and the shell; and biasingly ratcheting the end of the tab into said serrations.

* * * * *